US005454351A

United States Patent [19]

Cao et al.

[11] Patent Number: 5,454,351

[45] Date of Patent: Oct. 3, 1995

[54] ENGINE PISTON

[76] Inventors: Yiding Cao, 10900 SW. 104th St., #118, Miami, Fla. 33176; Qian Wang, 6890 SW. 88 St., #B103, Miami, Fla. 33156

[21] Appl. No.: 221,500

[22] Filed: Apr. 1, 1994

[51] Int. Cl.[6] ..... F02F 3/18

[52] U.S. Cl. ..... 123/41.35

[58] Field of Search ..... 123/41.35

[56] References Cited

U.S. PATENT DOCUMENTS 4,470,375 9/1984 Showalter ..... 123/41.35

*Primary Examiner*—Noah P. Kamen

[57] ABSTRACT

Described herein is an engine piston that incorporates reciprocating heat pipes for temperature reduction in the upper section of the piston. The reciprocating heat pipes are arranged circumferentially, close to the piston ring grooves, and extend from the region of the top ring groove to the piston skirt region. Since the reciprocating heat pipe has a very high thermal conductance, excessive heat in the top ring groove region can be transferred to the heat pipe section corresponding to the piston skirt region, where accessibility to the cooling oil is much greater, and heat can be dissipated via oil splash/mist or jet impingement cooling. Also, the heat dissipation area in contact with the cooling oil is significantly increased. As a result, the temperature in the upper section of the piston can be considerably decreased. The temperature reduction in the upper section of the piston, including the top ring groove region, would significantly improve engine thermal efficiency and performance of the piston assembly.

6 Claims, 3 Drawing Sheets

ENGINE PISTON

FIELD OF THE INVENTION

This invention relates to internal combustion engines, and more particularly, to engine pistons.

The invention can find applications in diesel and gasoline engines, and improve engine thermal efficiency, as well as performance of the piston assembly.

BACKGROUND OF THE INVENTION

The piston is one of the most important but vulnerable components in various kinds of internal combustion engines. As the engine is pushed to higher and higher thermal efficiency, the piston is required to work in a more hostile operating environment. One of the working limits for a piston is the maximum temperature that a piston can sustain. This is especially important for aluminum-alloy based pistons, which have a pronounced temperature dependence on their mechanical properties. The rapid fall-off of the mechanical properties of the piston alloy at temperatures above 200° C. is responsible for piston ring sticking and piston material transfer due to contact wearing. Aluminum-alloy based pistons also have a very large coefficient of thermal expansion. Problems occurring as a result of piston temperature increase also include coking, deterioration of lubricants, and increase in the designed clearance between the piston and cylinder liner, which can result in noise and vibration due to piston slapping. All of these problems would lead to a dramatic decrease in engine thermal efficiency and service life. For diesel engines, a higher engine thermal efficiency and less smoke due to improvement in air utilization could be realized by increasing the engine compression ratio. This will in turn result in a higher engine working temperature and a higher piston temperature in the ring groove region of the piston.

Piston cooling is a critical measure to achieve a higher engine performance. However, it is difficult to implement the cooling due to the reciprocal motion of the piston. Transferring heat away from the piston through the cylinder wall is also limited due to the small contact area between the piston and the cylinder wall. A commonly used method for cooling pistons is the crankcase oil splash/mist undercrown cooling. Above a certain rating, additional oil cooling is necessary and this is required for medium and high speed engine pistons. Provision of an internal cooling gallery allows a larger cooling surface and a shorter heat flow path as compared to the undercrown cooling. However, the gallery has a reputation of causing stress concentration and reducing piston strength in the ring groove region. Also, since the gallery is located in the upper section of the piston, it is difficult for the cooling oil to reach the gallery from the crankcase. Jet cooling has also been used to cool the upper section of the piston. The oil may be supplied from a standing jet fixed in the crankcase or through a drilled connecting rod. Although jet cooling may be more effective than splash/mist cooling, accurate jet alignment and capture efficiency are practically not without problems due to the rapid reciprocating motion of the piston.

SUMMARY OF THE INVENTION

The object of this invention is to incorporate the reciprocating heat pipe into the piston for more effective piston cooling. Heat pipes are heat transfer devices that could have an effective thermal conductance hundreds of times higher than that of copper. Detailed descriptions on heat pipes, including two-phase closed thermosyphons, can be found in a publication entitled *Heat Pipes*, by P. D. Dunn and D. A. Ready, Pergamon, N.Y., 1982, where a general description on heat pipes is contained on pages 1 to 20. For conventional heat pipes, liquid condensate is returned from the condenser to the evaporator via the capillary pumping force developed in a wick structure or with the assistance of gravity. The reciprocating heat pipe may be similar in structure to the wickless two-phase closed thermosyphon. However, the working principle of the reciprocating heat pipes is significantly different from that of the conventional heat pipe. For the reciprocating heat pipe, the liquid return is accomplished through the high frequency shaking-up action due to the reciprocating motion of the piston. The liquid splash and impingement on the interior surface also facilitates temperature uniformity along the heat pipe. Moreover, the function of the reciprocating heat pipe will not be affected by the orientation of the piston assembly, although a vertical engine with a horizontal crank shaft is employed here to describe the invention.

The reciprocating heat pipe used for piston cooling can be a copper-water heat pipe. The reciprocating heat pipe can be pre-manufactured and installed into a piston by the cast-in method. Since copper has a coefficient of thermal expansion very close to that of aluminum alloys, the heat pipe thus installed will not present any structural problem due to thermal expansion. Also, since the reciprocating heat pipe is a thin-walled hollow structure, the piston weight increase due to the incorporation of the reciprocating heat pipe is very small. Reciprocating heat pipes are installed in the region close to the piston ring grooves, and are arranged circumferentially, extending from the top ring groove region of the piston to the piston skirt region. The aforementioned new engine piston has the following technological advantages:

1. Since the heat pipe has a very high thermal conductance (hundreds of times higher than that of copper), excessive heat in the top ring groove region can be transferred to the lower skirt region of the piston, where the cooling oil is much more accessible, and the heat can then be dissipated via oil splash/mist or jet impingement cooling. Also, the heat dissipation area in contact with the cooling oil is significantly increased. As a result, the temperature in the top ring groove and top skirt regions can be significantly decreased, and the piston can work at a better thermal condition. The degradation of the lubricant and the aluminum alloy will also be greatly reduced, and hence, both the performance of the piston assembly and the life of the interface between the piston and the cylinder would be significantly improved.
2. The cooling gallery may be eliminated due to the installation of the reciprocating heat pipes. Therefore, the structural problem associated with the gallery failure can be avoided.
3. The reciprocating heat pipe has a very simple structure with a low manufacturing cost. Also, the cast-in method for installation of the reciprocating heat pipe is a well-established technology. Therefore, the cooling method presented herein provides a unique cooling technology without any technological barrier.

DETAILED DESCRIPTION OF THE INVENTION

Figure 2:
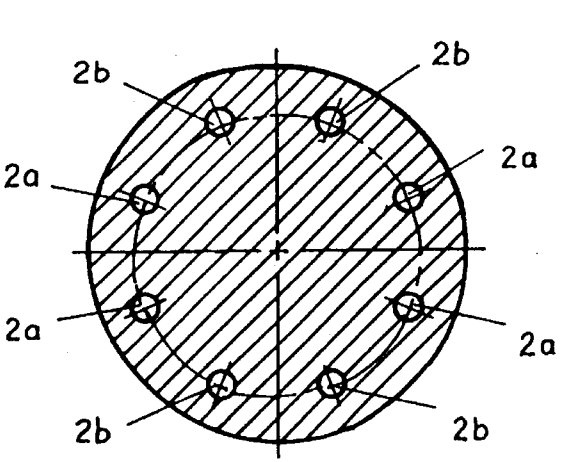
FIG. 2 is a section taken along the line, A—A, of FIG. 1.
Figure 1:
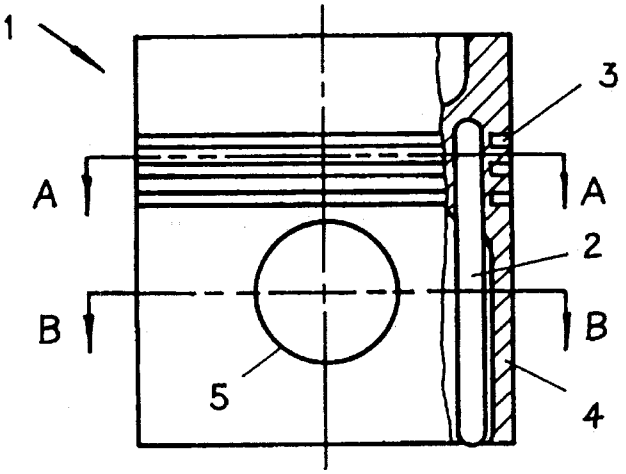
FIG. 1 is a schematic, partially cut-away view of a reciprocating heat pipe cooled piston.
Figure 3:
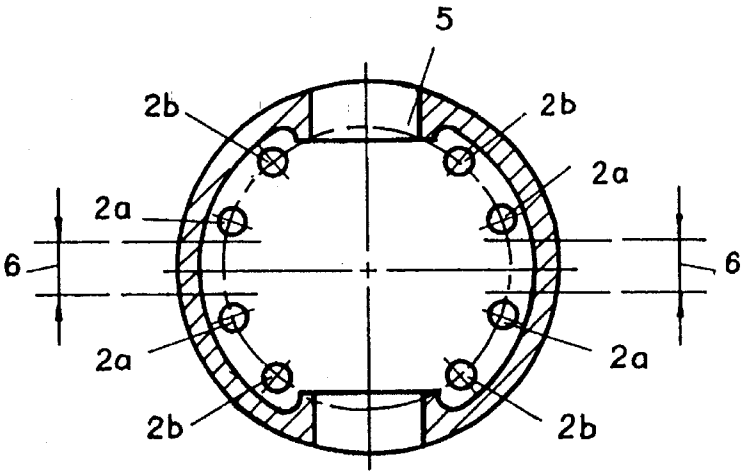
FIG. 3 is a section taken along the line, B—B, of FIG. 1.

FIG. 1 schematically shows a partially cut-away view of a piston 1 incorporating reciprocating heat pipes. Reciprocating heat pipes 2 are inserted into the piston in the region close to the top ring groove 3. A number of such reciprocating heat pipes are arranged circumferentially as shown in FIG. 2. In the upper section of the piston that corresponds to the region with ring grooves, the reciprocating heat pipes can be arranged with the same pitch along the circumference. In the lower skirt region 4 of the piston, however, the heat pipes can be placed only in certain segments along the circumference due to the existence of the piston bearing 5 for the wrist pin joint, and the clearance 6 (FIG. 3) needed for the oscillation of the connecting rod. As a result, two slightly different kinds of reciprocating heat pipes, straight reciprocating heat pipes 2*a* and curved reciprocating heat pipes 2*b*, are used in the piston. The use of a curved reciprocating heat pipe is to place the lower section of the heat pipe in certain permissible circumferential segments, while maintaining the same heat pipe pitch circumferentially in the upper section. The heat pipe is integrated with the piston in the upper section of the piston by a cast-in process. In the lower section, however, the heat pipe may not contact the thin-walled piston skirt, therewith the temperature of the piston skirt 4 may not be affected by the heat pipe temperature. Also, the reciprocating heat pipe can be more effectively cooled by the oil splash in the lower section.

Figure 5:
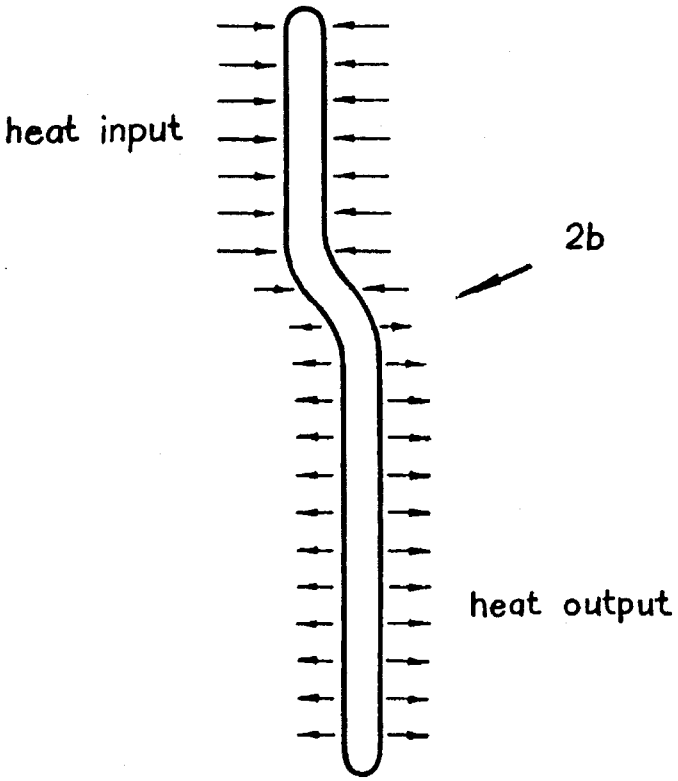
FIG. 5 is a schematic representation of a curved reciprocating heat pipe.
Figure 4:
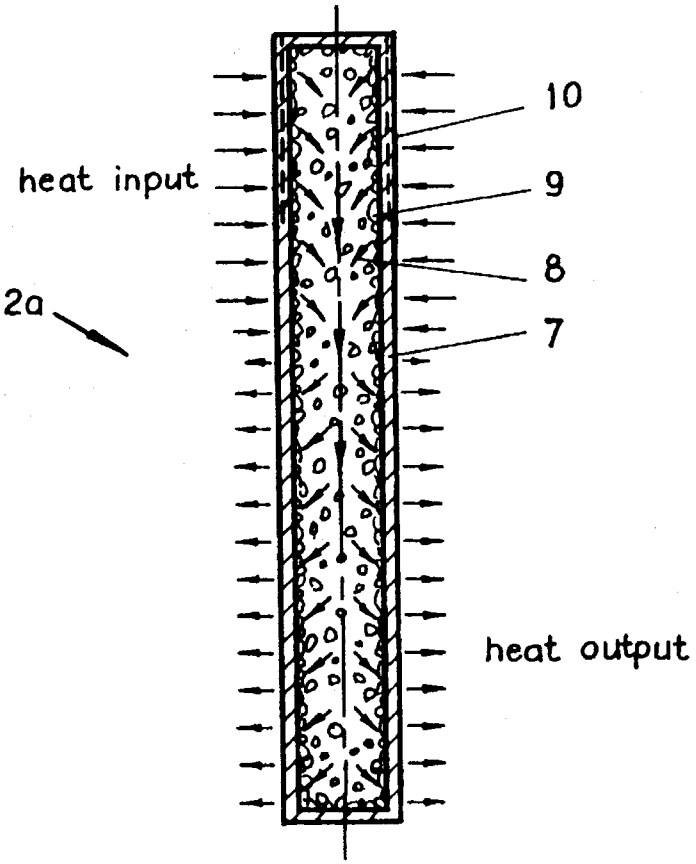
FIG. 4 is a schematic representation of a straight reciprocating heat pipe and the interior working condition.

FIG. 4 is a schematic representation of a straight reciprocating heat pipe 2*a*. For the present application, the upper section of the heat pipe functions as the evaporator, and the lower section of the heat pipe functions as the condenser. The upper section of the heat pipe absorbs heat from the top ring groove region of the piston, and the heat is conducted through the heat pipe container wall 7 to the interior surface, where it is absorbed due to the liquid vaporization. The vapor 8 flows from the upper evaporator section down to the lower condenser section and condenses at the interior surface in the condenser section. The latent heat released due to the condensation is conducted through the container wall 7 to the exterior surface where the heat is carried away by the cooling oil. The major difference between the reciprocating heat pipe and the conventional heat pipe is the liquid returning mechanisms. For conventional heat pipes, the liquid condensate is returned from the condenser section to the evaporator section through capillary, gravity, or centrifugal force. However, for the reciprocating heat pipe, the liquid condensate is returned through the inertia force and impingement due to the reciprocating motion of the heat pipe. The liquid 9 is dispersed and distributed over the interior surface of the heat pipe, which secures a liquid supply for the vaporization in the evaporator section. The aforementioned evaporation and condensation is a typical two-phase heat transfer mechanism. However, even without evaporation and condensation in the heat pipe, the heat transfer is still very effective from a single-phase heat transfer point of view. Due to the high frequency shaking-up action of the piston, liquid particles will alternatively impinge upon upper-hotter and lower-colder interior wall surfaces of the heat pipe container, therewith effectively carrying the heat from the hotter section to the colder section. FIG. 5 is a schematic representation of a curved reciprocating heat pipe 2*b*. The working principle for the curved reciprocating heat pipe is similar to that of the straight reciprocating heat pipe. Other types of curved reciprocating heat pipes, which are different from the curved heat pipe shown in FIG. 5, can also be used whenever it is necessary.

The shell material of the reciprocating heat pipe can be copper or other materials, and the working fluid filled inside the heat pipe can be water or other fluids. The normal working temperature for a water heat pipe is from 30° to 300° C., which is one of the best working fluids for this application. The compatibility between water and copper is also well-proven. In addition, water has a very high latent heat of vaporization and a very high convective heat transfer coefficient, both of which contribute to the high heat transfer rate of the reciprocating heat pipe.

Since copper has a higher density than most of aluminum alloys, the weight of a piston could be somehow increased due to the installation of the heat pipe. However, since the heat pipe has a hollow structure, the increase in weight is very small. Considering a reciprocating heat pipe with a radius of 5 mm and a container wall thickness of 1 mm, the weight ratio of the copper heat pipe to the aluminum having the same volume as the heat pipe is about 1.15 to 1. The weight ratio based on the whole piston should be much smaller than this number, and should be very close to unity.

Since copper has a much higher melting temperature than that of aluminum alloys, the reciprocating heat pipe can be pre-manufactured, and be cast into the piston. Also, the reciprocating heat pipe has a very simple structure, as shown in FIG. 4 and FIG. 5, therefore, the increased manufacturing cost of the piston should be relatively small. In addition, copper has a coefficient of thermal expansion very close to that of aluminum, and the installation of the reciprocating heat pipe will not cause any piston structural problem due to the thermal stress. Small grooves 10, as represented by the dashed lines in FIG. 4, may be machined into the outer surface of the heat pipe container in the upper section to further secure the integration of the heat pipe with the piston.

Figure 7:
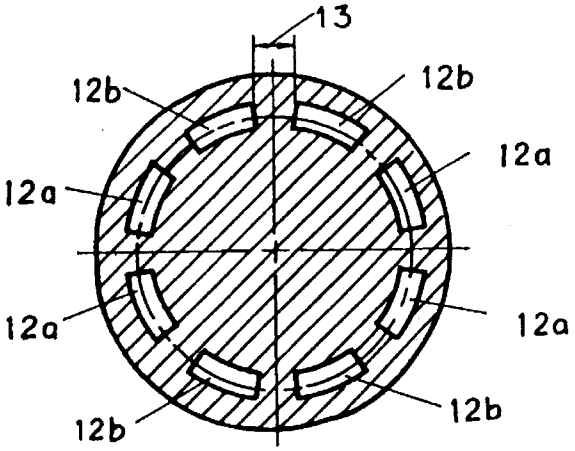
FIG. 7 is a section taken along the line, A—A, of FIG. 1 for a piston incorporating studshaped reciprocating heat pipes.
Figure 6:
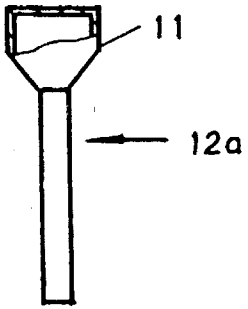
FIG. 6 is a schematic, partially cut-away view of a stud-shaped reciprocating heat pipe.

The contact area between the evaporator section of the reciprocating heat pipe and the high temperature region of the piston determines the heat transfer efficiency and the temperature distribution in the ring groove region of the piston. The stud-shaped reciprocating heat pipe 12*a* shown in FIG. 6 can be used to increase the heat transfer capacity and reduce the circumferential temperature non-uniformity in the ring groove region of the piston. The stud-shaped reciprocating heat pipe has an enlarged upper end portion 11, which is placed close to the ring groove region of the piston. The cross-sectional view of the piston using the stud-shaped reciprocating heat pipes, taken along the line, A—A, of FIG. 1, is shown in FIG. 7. The use of this stud-shaped reciprocating heat pipe significantly increases the heat transfer area between the heat pipe and the upper high temperature region of the piston, and enhances the heat pipe cooling capacity.

Figure 8:
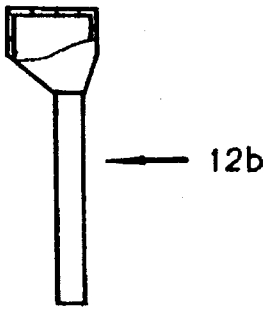
FIG. 8 is a schematic, partially cut-away view of a non-symmetric stud-shaped heat pipe.

Also, the distance 13 in FIG. 7 between the adjacent heat pipes in the upper section of the piston is dramatically reduced, which, in turn, contributes to the temperature uniformity in the circumferential direction. The evaporator section of the heat pipes shown in FIG. 7 may have arcuate shape so as to extend parallel to the piston perimeter. As mentioned earlier, in the lower skirt region, the heat pipe can be placed only in certain segments along the circumference because of the wrist pin joint and the clearance for the connecting rod. In order to avoid using the curved heat pipe similar to that in FIG. 5, non-symmetric, stud-shaped reciprocating heat pipes **12*b* shown in FIG. 8** can be used.

Figure 9:
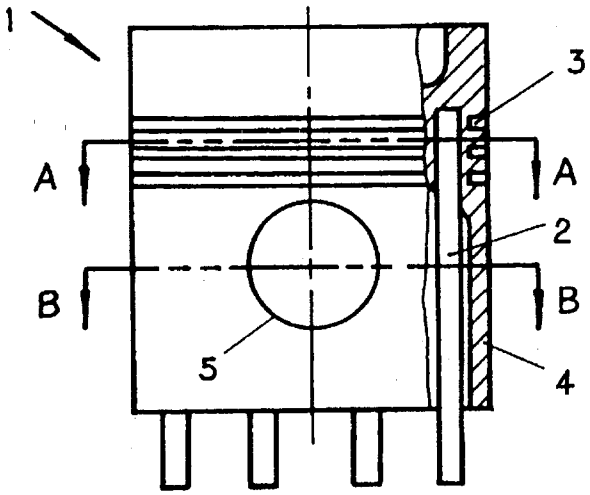
FIG. 9 is a schematic, partially cut-away view of a reciprocating heat pipe cooled piston, with the heat pipe extending beyond the piston skirt region.

For a piston with a short skirt height, a similar enlarged end portion can also be used for the lower section of the heat pipe to increase the heat transfer area between the lower part of the heat pipe and the engine cooling oil. Or, the reciprocating heat pipe can be extended further downwardly beyond the piston skirt region, as shown in FIG. 9, if such an arrangement is permissible. The enlarged end portion can be fabricated in a process such as casting, and then be welded to the remaining part of the heat pipe. The structure of the stud-shaped heat pipe also aids in the integration of the heat pipe itself with the piston.

We claim:

1. An engine piston comprising an upper section including at least one piston groove with a sealing ring, a lower section including a piston skirt and a wrist pin joint, at least one elongate heat pipe having an evaporator section imbedded in said upper section adjacent said groove and a condenser section proximate said lower section but spaced from said skirt, whereby said condenser section is adapted to be cooled by engine sprayed engine oil.

2. The invention as set forth in claim 1, wherein there are a plurality of heat pipes circumferentially disposed about a perimeter of said piston.

3. The invention as set forth in claim 1, wherein said condenser section extends below said skirt.

4. The invention as set forth in claim 1, wherein said heat pipe contains water.

5. The invention as set forth in claim 1, wherein said evaporator section has an arcuate shape extending parallel to a perimeter of said piston.

6. The invention as set forth in claim 1, wherein the heat pipe has a bend between said upper and lower sections.

* * * * *